US006857144B1

(12) United States Patent
Huang

(10) Patent No.: US 6,857,144 B1
(45) Date of Patent: Feb. 22, 2005

(54) FOLDABLE LIFT AND TRANSFER APPARATUS FOR PATIENT

(76) Inventor: Chi-Tzung Huang, No. 96-25, Lun-Wei, Mei-Nan-Ts'Un, Shi-Koou Shiang, Chia Yi (TW)

( * ) Notice: Subject to any disclaimer, the term of this patent is extended or adjusted under 35 U.S.C. 154(b) by 0 days.

(21) Appl. No.: 10/638,412

(22) Filed: Aug. 12, 2003

(51) Int. Cl.[7] ..... A61G 7/14; A61G 7/10
(52) U.S. Cl. ..... 5/86.1; 5/81.1 R
(58) Field of Search ..... 5/86.1, 81.1 R, 5/83.1

(56) References Cited

U.S. PATENT DOCUMENTS 3,203,009 A * 8/1965 Olaf ..... 5/87.1

* cited by examiner

*Primary Examiner*—Alexander Grosz
(74) *Attorney, Agent, or Firm*—Rosenberg, Klein & Lee

(57) ABSTRACT

A lift and transfer apparatus for patient has a wheeled support base, and a main support post; the base has an upwards projecting securing portion, which has a locating room defined by front and rear short plates, and left and right inverted L shaped long plates, which each has an inverted L shaped guiding slot; the post is inserted into the locating room at lower end, and secured to the securing portion with bolts, a second one of which bolts is passed through the slots, and the post; thus, the slots allows the post to be displaced towards rear side of the apparatus until the second bolt abuts slot upper rear ends after the other bolts have been removed, and the second bolt loosened, and after the post is pivoted downwards for folding the apparatus, and length of the apparatus, in folded position, can be reduced.

1 Claim, 9 Drawing Sheets

FOLDABLE LIFT AND TRANSFER APPARATUS FOR PATIENT

BACKGROUND OF THE INVENTION

1. Field of the Invention

The present invention relates to a foldable lift and transfer apparatus for patient, more particularly one having a lifting mechanism, which can be linearly displaced relative to a lower transferring mechanism so as to further help reduce dimension of the whole apparatus after the apparatus is folded with the lifting mechanism being angularly displaced relative to the lower transferring mechanism.

2. Brief Description of the Prior Art

Referring to FIG. 8, a conventional foldable lift and transfer apparatus for patient was devised by inventor of the present invention, which includes a base, a support post pivoted to the base at a lower end, a lifting rod pivoted to an upper end of the support post, a hanging element hung on the lifting rod, and a lifting device. The base has wheels connected to it. The lifting device is pivoted to connecting ears of a middle portion of the support post at a lower end, and has an output rod, which is pivoted to connecting ears of the lifting rod at a tail end.

The lift and transfer apparatus is characterized by the shape of the support post; the support post is formed such that angle θ1 is formed between a lower section thereof and a vertical line when the apparatus is in stretched in-use position, and such that angle θ2 is formed between an upper section thereof and a vertical line, and the support post has a folded upper end such that θ3 is formed between an axis of the folded upper end and an axis of the upper section, and such that angle θ4 is formed between a vertical line and a line connecting a lower pivotal pin and an upper pivotal pin; thus, the lifting rod is provided with more space for the pivotal movement thereof, and the length of the support post is reduced, an in turns, the apparatus will be shorter when it is folded.

Referring to FIG. 9, another conventional foldable lift and transfer apparatus for patient was devised by inventor of the present invention, which includes a base, a support post connected to the base at a lower end, a lifting rod, a hanging element hung on the lifting rod, and a lifting device. The base has wheels connected to it. The lifting device is pivoted to connecting ears of a middle portion of the support post at a lower end, and has an output rod, which is pivoted to connecting ears of one end of the lifting rod at a tail end.

A joining rod is pivoted to an upper end of the support post at one end, and has two opposing connecting plates projecting from the other end; the connecting plates have two pairs of opposing holes. The lifting rod has two holes at a rear end, and is inserted between the connecting plates at the rear end with a spring pin, and a pivotal pin being inserted through the holes of the connecting plates and the holes thereof; thus, the lifting rod is held still on the support post, and can be pivoted on the pivotal pin when the spring pin is removed. The base also has two opposing connecting plates projecting up from it. The support post has two holes at the lower end, and is inserted between the connecting plates at the lower end with a spring pin, and a pivotal pin being inserted through the holes of the connecting plates as well as the holes thereof; thus, the support post is held still on the base, and can be pivoted on the pivotal pin for folding the apparatus when the spring pin is removed.

Both of the above lift and transfer apparatuses have a common disadvantage that the support posts will cause increase to the length of the whole apparatuses after they are pivoted down close to the bases for folding the apparatuses because they can't be displaced relative to the bases after the downward pivotal movement. Consequently, the apparatuses will occupy more space in packaging and storage.

SUMMARY OF THE INVENTION

It is a main object of the present invention to provide a foldable lift and transfer apparatus for patient, which is made such that the length thereof can be reduced when it is folded, and such that it takes less effort and strength to operate.

The lift and transfer apparatus for patient has a transfer mechanism, and a lift mechanism; the transfer mechanism includes a support base, two support rods pivoted to the base at rear portions close to rear ends thereof, front wheels connected to front ends of the support rods, rear wheels, and a control member for changing orientation of the support rods with; the lift mechanism includes a post connected to the base at a lower end, a lifting rod pivoted to an upper end of the post, and a lifting hydraulic cylinder for changing height of the lifting rod with. The rear wheels are connected to the support base instead of the support rods so that it takes less force to operate the control member to change orientation of the support rods and the front wheels. The post is formed with a folded portion between two ends while the lifting hydraulic cylinder is supported on a lower end of the folded portion of the post; an upper portion of the main support post is closer to a rear side of the apparatus than a lower portion of the post such that an effort arm of the lifting rod is allowed to be lengthened. The base has an upwards projecting securing portion, which has a locating room defined by front and rear short plates, and left and right inverted L shaped long plates, which each has an inverted L shaped guiding slot; the post is inserted into the locating room at lower end, and secured to the securing portion with bolts, a second one of which bolts is passed through the slots, and the post; thus, the slots allows the post to be displaced towards rear side of the apparatus until the second bolt abuts slot upper rear ends after the other bolts have been removed, and the second bolt loosened, and after the post is pivoted downwards for folding the apparatus, and length of the apparatus, in folded position, can be reduced.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
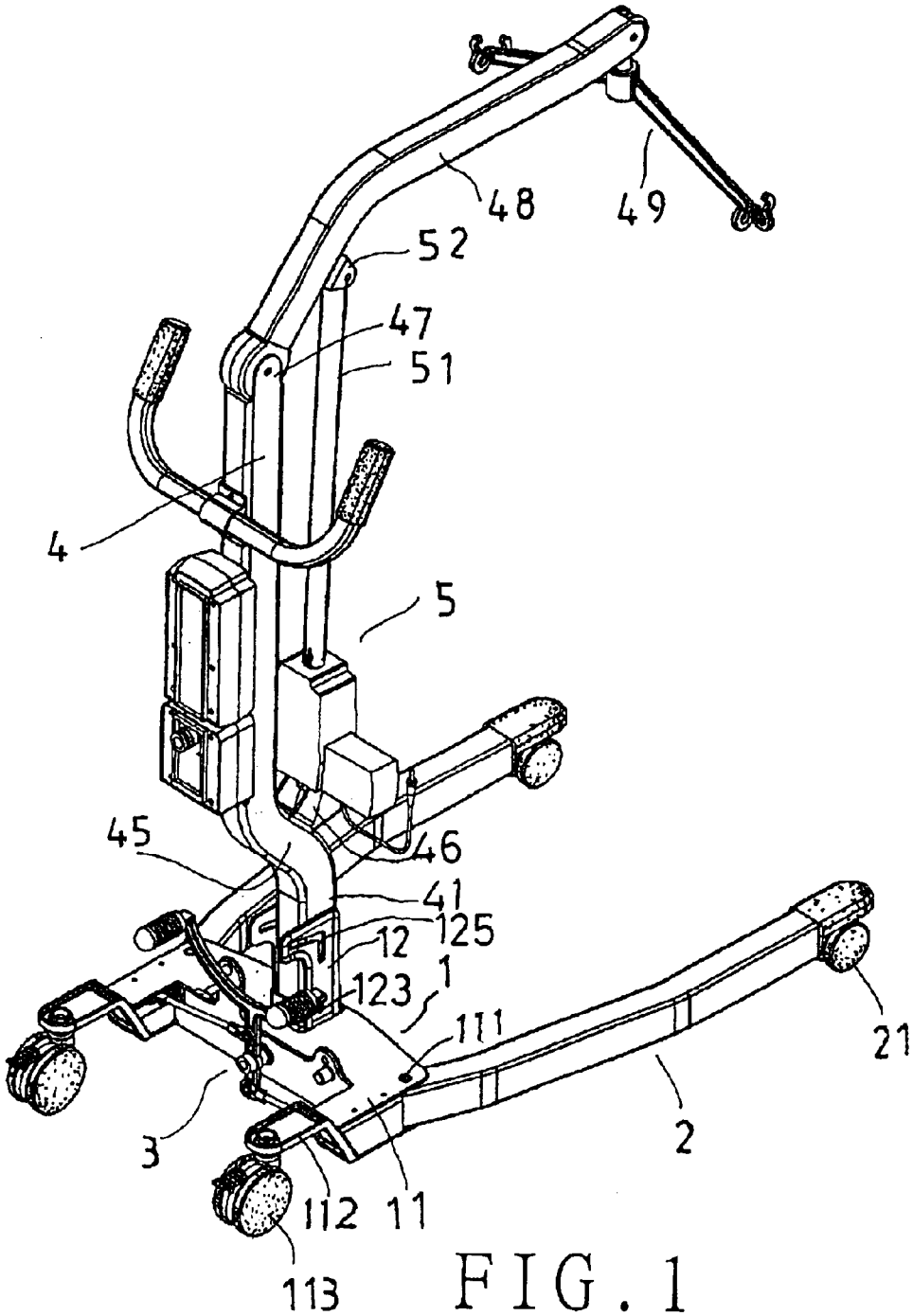
FIG. 1 is a perspective view of the foldable lift and transfer apparatus for patient according to the present invention.

Referring to FIG. 1, a preferred embodiment of a foldable lift and transfer apparatus for patient in the present invention consists of a transferring mechanism, which includes a support base 1, two support rods 2, and a control member 3, and a lifting mechanism, which includes a main support post 4, a lifting rod 48, and a lifting hydraulic cylinder 5.

Figure 2:
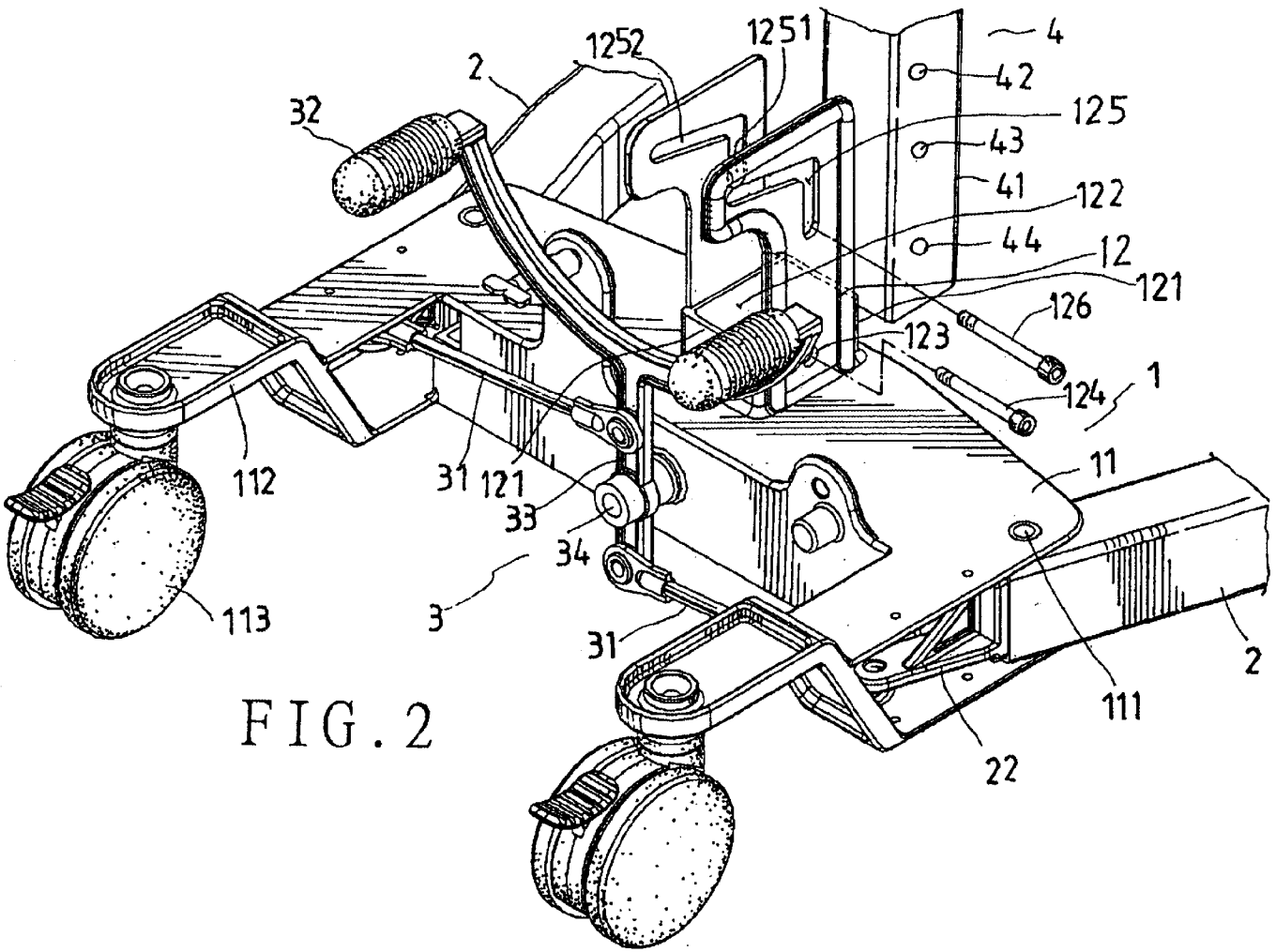
FIG. 2 is a partial perspective view of the foldable lift and transfer apparatus for patient according to the present invention.
Figure 3:
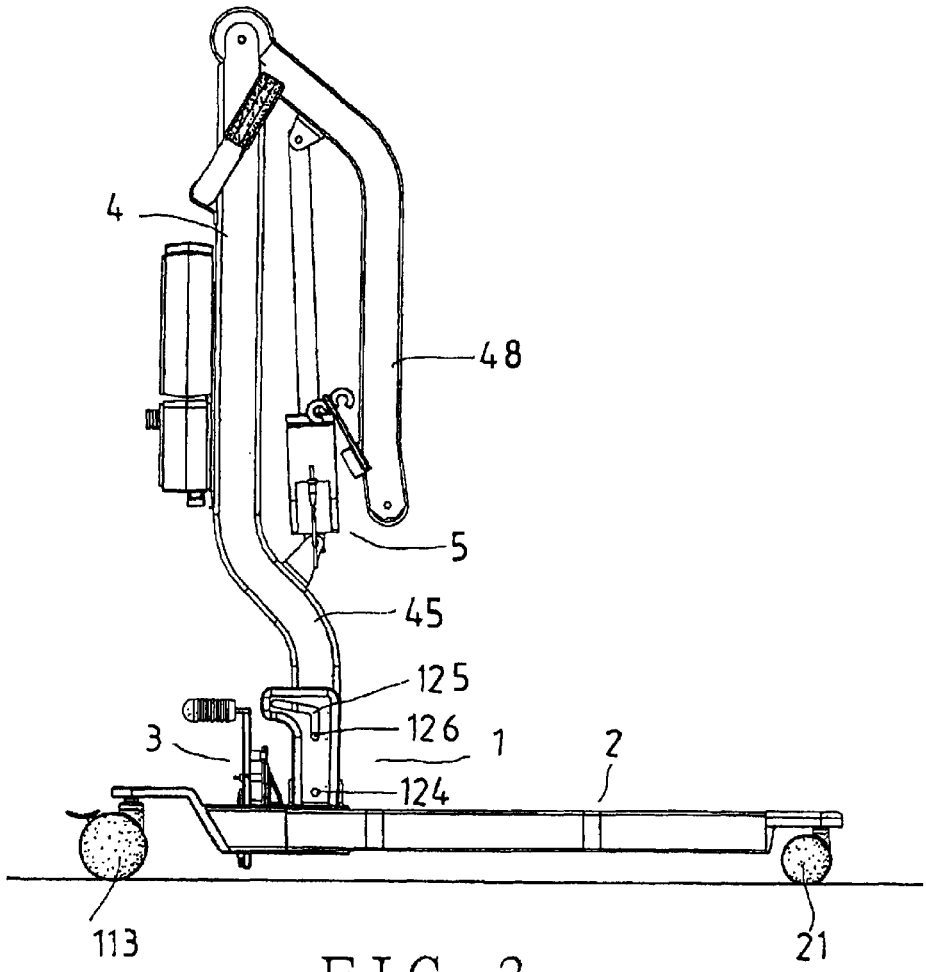
FIG. 3 is a side view of the present foldable lift and transfer apparatus for patient, at a first stage of the folding movement.

Referring to FIGS. 1, and 2, the support base 1 has upper and lower support plates 11, 11, two extension portions 112 projecting rearwards from the support plates 11, and a securing portion 12 projecting up from the upper support plate 11. The securing portion 12 includes front and rear short plates 121, left and right long plates, which are joined to the edges of the short plates at the edges thereof, and a locating room 122 defined by the short and the long plates. Each of the long plates of the securing portion 12 is formed with an inverted L shape, and has an inverted L shaped guiding slot 125 on an upper portion, and a lower connecting hole 123 on a lower end portion; each inverted L shaped guiding slot 125 has a vertical section 1251, and a horizontal or slightly sloping section 1252; the upper ends of the inverted L shaped long plates of the securing portion 12 are preferably made to extend rearwards as far as possible on condition that they will not interfere operation of the control member 3, which will be detailed later; thus, the upper ends of the inverted L shaped guiding slots 125 are allowed to extend rearwards for desirable length. Rear wheels 113 are connected to the rear extension portions 112 of the support base 1.

The support rods 2 are passed between, and pivoted to the upper and the lower support plates 11 of the support base 1 by means of pivotal elements 111 at rear end portions thereof to project forwards. Each of the support rods 2 has a rear extension portion 22 arranged in a rear portion of a room between the upper and the lower support plates 11. Front wheels 21 are connected to front ends of the support rods 2.

The control member 3 includes a pedal rod 32, an actuating arm 33 connected to the pedal rod 32, and two connecting rods 31. The control member 3 is pivoted to a rear side of the support base 1 at a middle portion of the actuating arm 33 by means of a pivotal element 34. The connecting rods 31 are pivoted to respective ones of the rear extension portions 22 of the forwards projecting support rods 2 at outward ends thereof, and are respectively pivoted to upper and lower ends of the actuating arm 33 at inward ends thereof. Thus, orientation of the forwards projecting support rods 2 can be adjusted by means of the pedal rod 32. And, because the rear wheels 113 are connected to the support base 1 instead of the support rods 2, it takes less force to control the control member 3 to change the orientation of the support rods 2, and the present apparatus is convenient to use.

The main support post 4 has a lower straight insertion end 41, a folded portion 45 extending the insertion end 41, and an upper straight portion extending from an upper end of the folded portion 45. The lower straight insertion end 41 is formed with an upper, an intermediate, and a lower through holes 42, 43, and 44. The folded portion 45 has pivotal projections 46 extending from an upper side of a lower end thereof while the upper straight portion has pivotal ears 47 extending from an upper end thereof.

The lifting rod 48 is pivoted to the pivotal ears 47 of the main support post 4 at one end, and has a lifting element 49 hung on the other end thereof for lifting a patient with. Pivotal ears 52 are secured to a lower side of the lifting rod 48 between the two ends.

The lifting hydraulic cylinder 5 is pivoted to the pivotal projections 46 of the main support post 4 at a lower end, and pivoted to the pivotal ears 52 at an upper end of an output rod 51 such that the lifting rod 48 can be moved by means of operating the hydraulic cylinder 5.

In combination, the lower straight insertion end 41 of the main support post 4 is inserted into the locating room 122 of the support base 1 such that the lower through hole 44 thereof is aligned with the lower connecting holes 123, and such that the intermediate through hole 43 thereof opposes the lower ends of the inverted L shaped guiding slots 125; the hydraulic cylinder 5 is closer to the front of the present apparatus than both the folded portion and the upper straight, portion of the main support post 4. And, a lower bolt 124 is screwed into the lower through hole 44, and the lower connecting holes 123 while an upper bolt 126 is screwed into the intermediate through hole 43, and the inverted L shaped guiding slots 125; thus, the main support post 4 is secured on the support base 1. Because the main support post 4 is formed with the intermediate folded portion 45, the length of the effort arm of the lifting rod 48 is increased, and the lifting hydraulic cylinder 5 can lift a patient with reduced force. In other words, the present apparatus takes less power to use.

Figure 4:
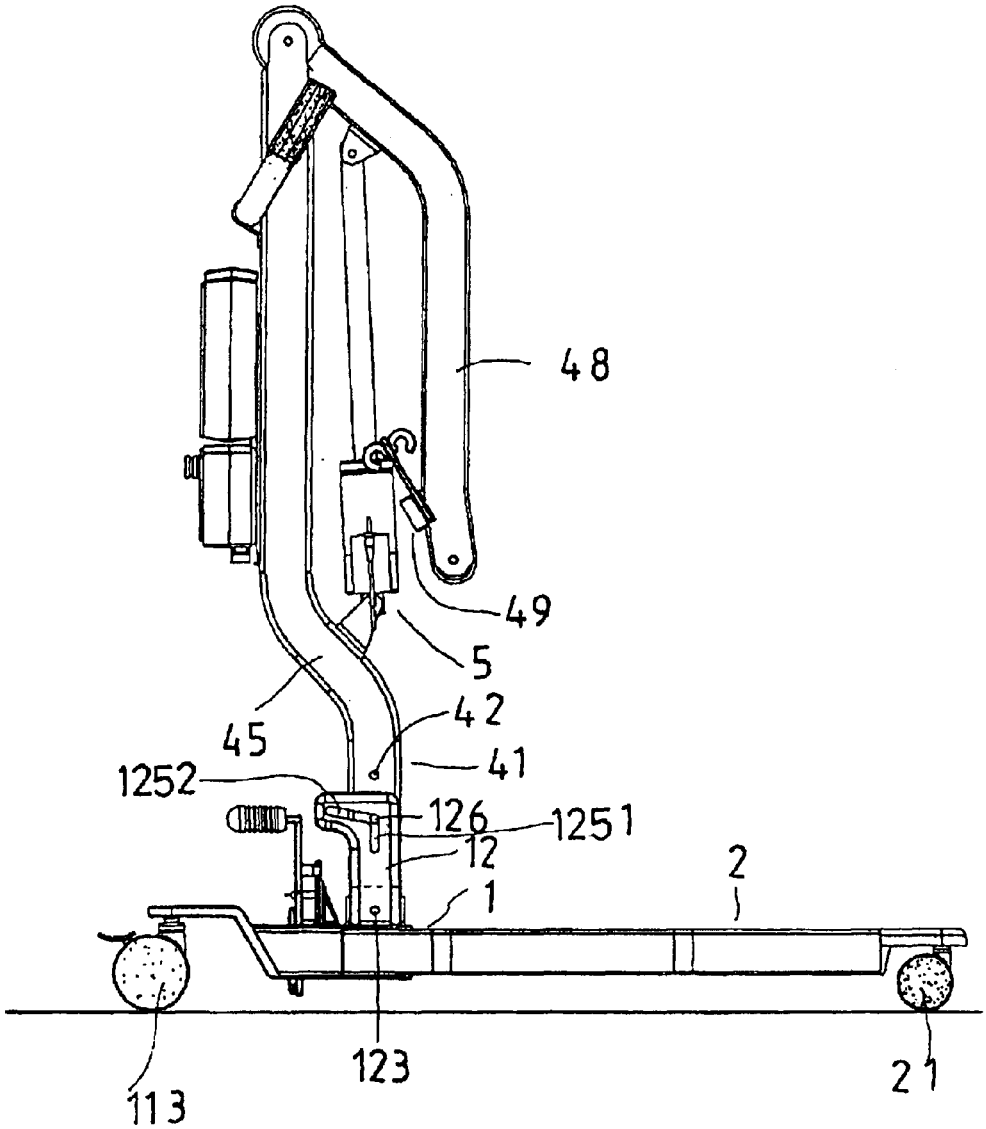
FIG. 4 is a side view of the present foldable lift and transfer apparatus for patient, at a second stage of the folding movement.
Figure 5:
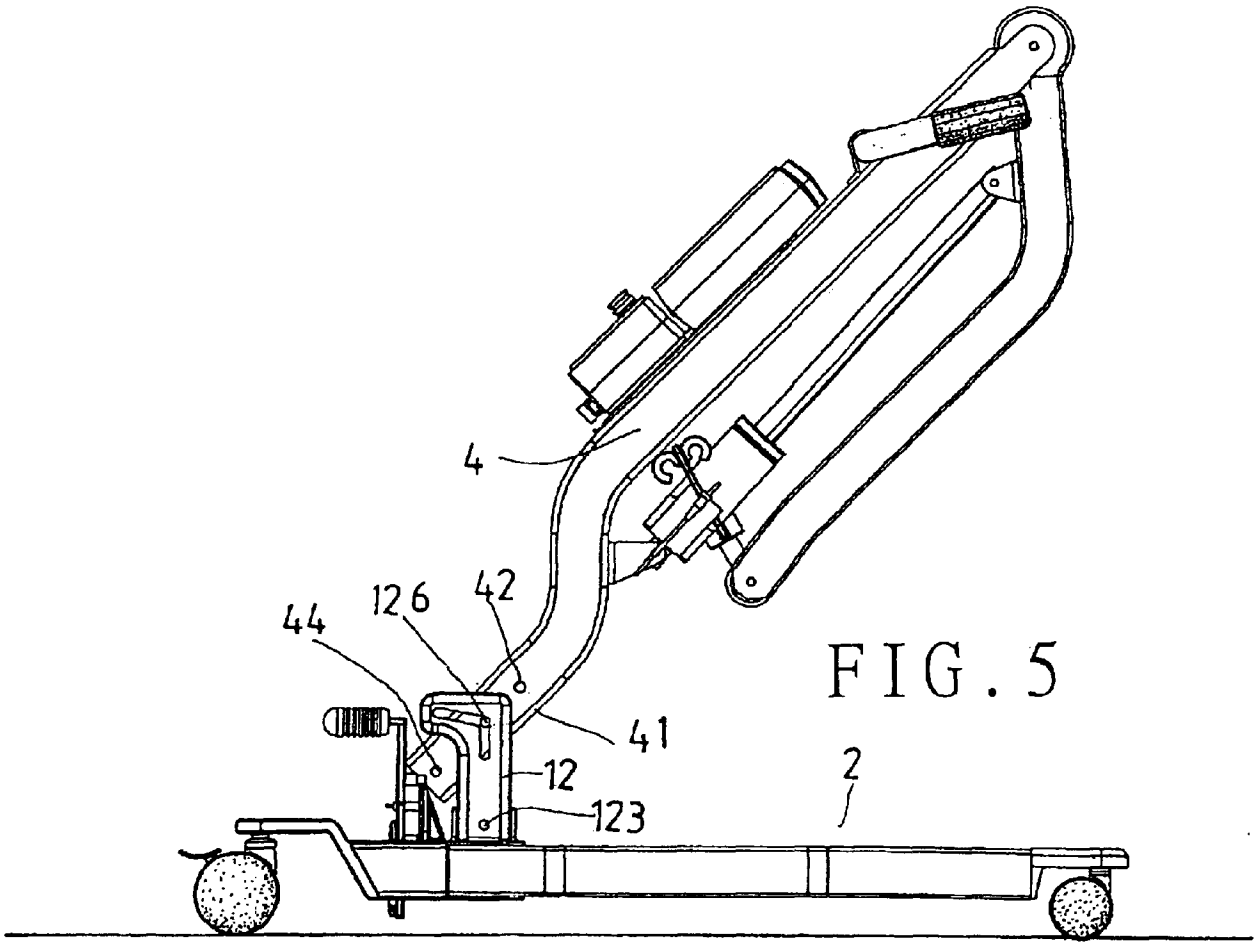
FIG. 5 is a side view of the present foldable lift and transfer apparatus for patient, at a third stage of the folding movement.
Figure 6:
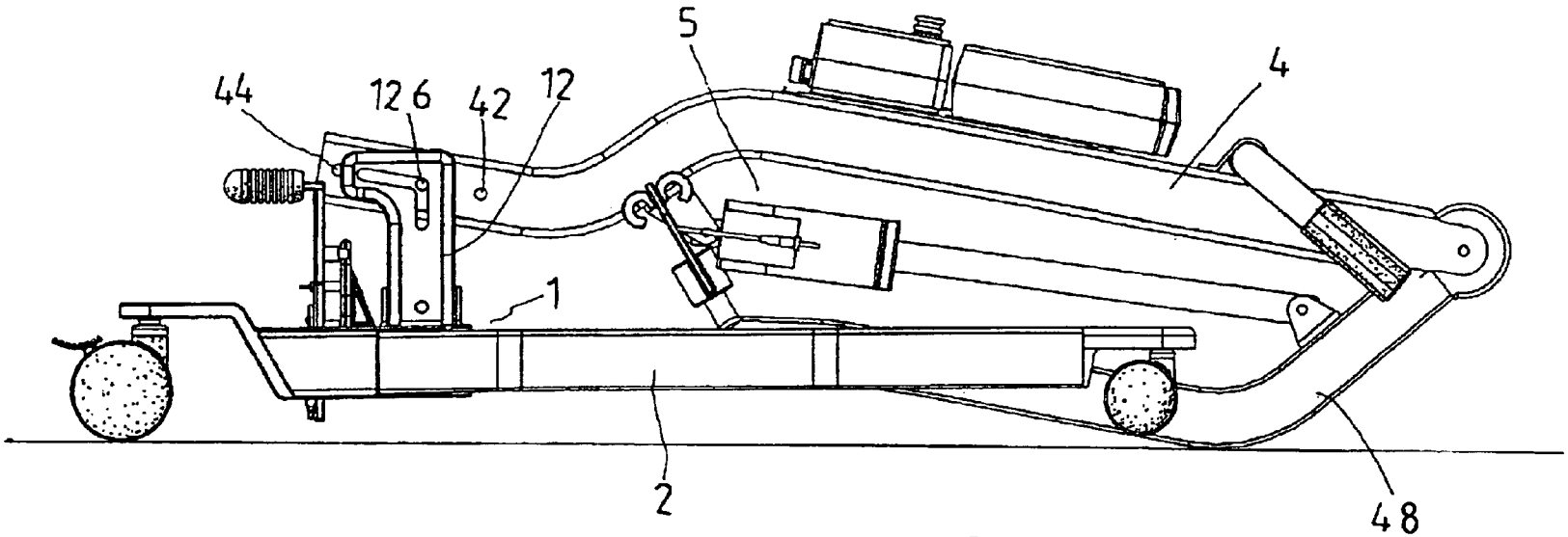
FIG. 6 is a side view of the present foldable lift and transfer apparatus for patient, at a fourth stage of the folding movement.
Figure 7:
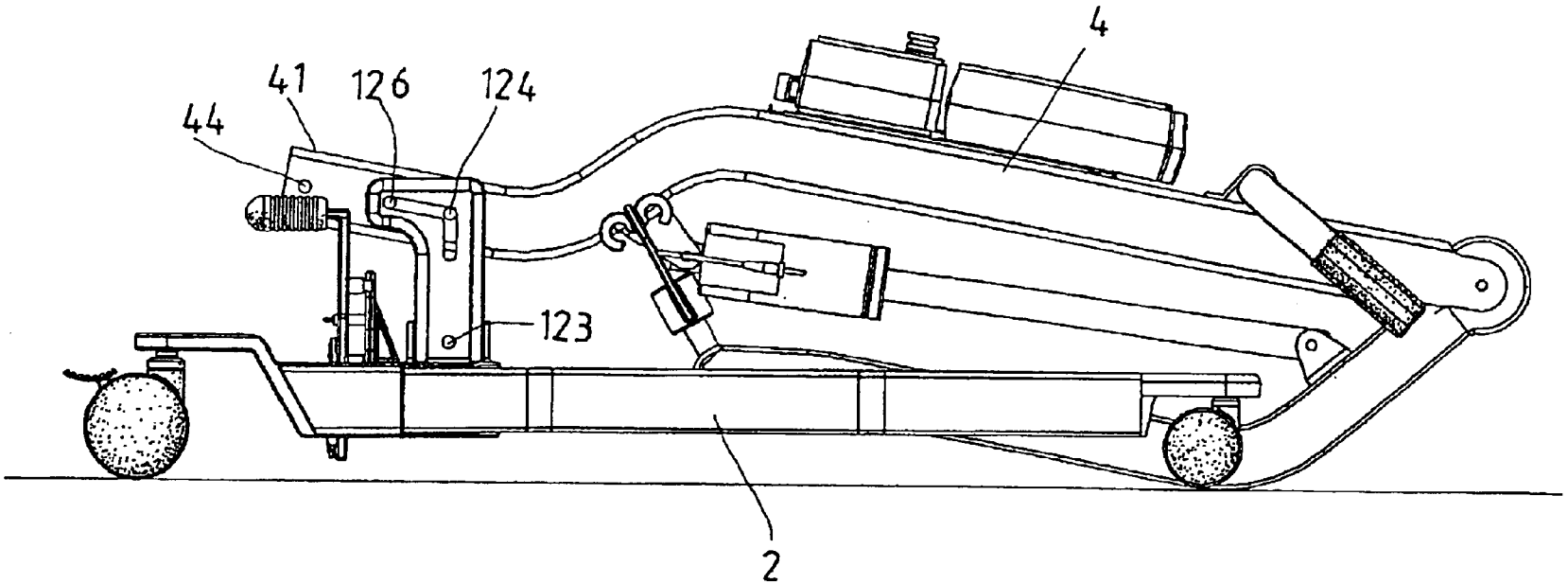
FIG. 7 is a side view of the present apparatus, after the lifting mechanism is linearly displaced relative to the transferring mechanism.
Figure 8:
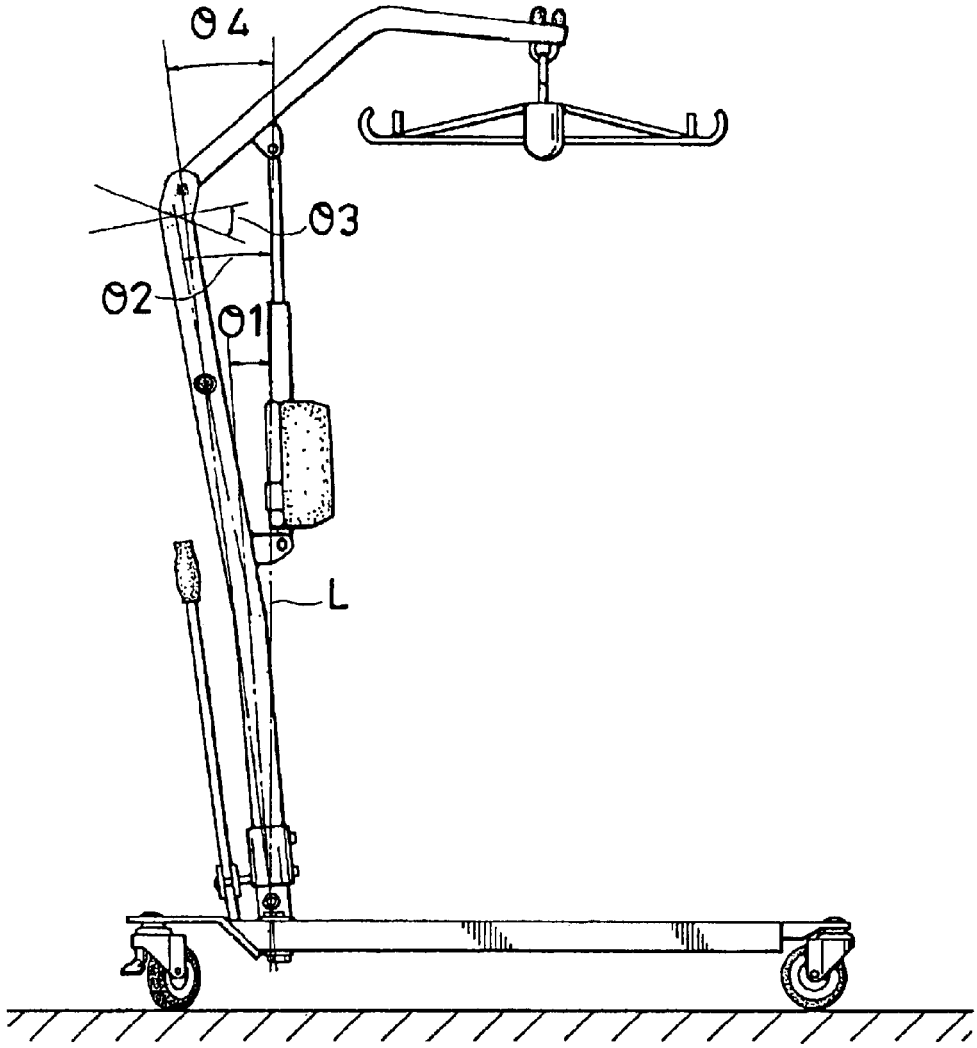
FIG. 8 (PRIOR ART)
FIG. 8 is a side view of the first conventional foldable lift and transfer apparatus for patient as described in the Background.
Figure 9:
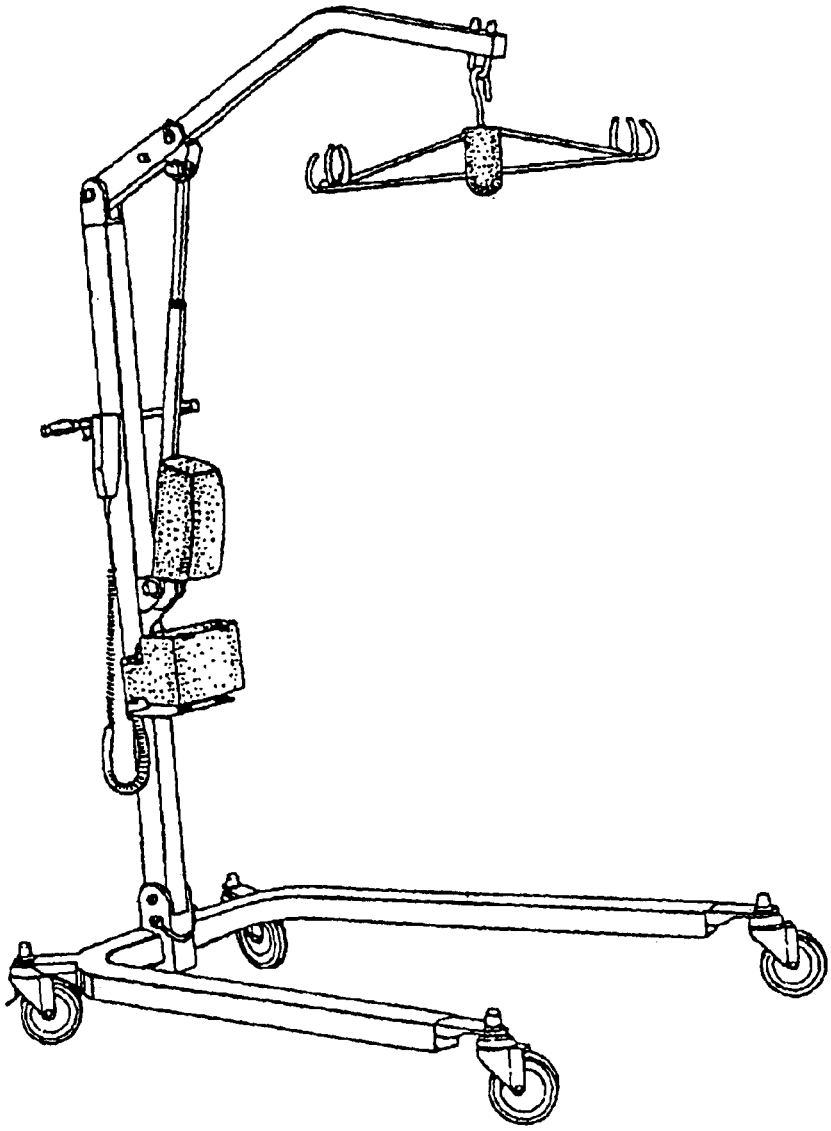
FIG. 9 (PRIOR ART)
FIG. 9 is a perspective view of the second conventional foldable lift and transfer apparatus for patient.

To fold the present lift and transfer apparatus, the bolt 124 is removed from the holes 44 and 123, and the bolt 126 is loosened, and then the main support post 4 is moved vertically up until the lower insertion end 41 separates from the locating room 122 after the lifting rod 48 has been moved close to the main support post 4; thus, the bolt 126 abuts the upper ends of the vertical sections 1251 of the inverted L shaped guiding slots 125, as shown in FIG. 4. Then, the main support post 4 is pivoted on the bolt 126 to be close to the support rods 2, as shown in FIGS. 5, and 6. Finally, the main support post 4 is moved towards the rear side of the present apparatus with the bolt 126 sliding along the sections 1252 of the guiding slots 125; thus, the bolt 126 abuts the rear ends of the sections 1252 of the guiding slots 125, and the upper through hole 42 of the post 4 opposes the upper ends of the slot vertical sections 1251, as shown in FIG. 7. And, the bolt 126 is tightened again, and the bolt 124, which has been removed from the holes 44 and 123, is passed through the hole 42 and the slot 125 to secure the post 4 to the securing portion 12. Consequently, the length of the folded apparatus is further reduced because of the above rearward displacement of the main support post 4.

From the above description, it can be easily understood that the lift and transfer apparatus of the present invention can be further reduced in length after it is folded, and in turns, it will occupy less space in packaging and storage. And, it takes less power and effort to operate the present apparatus.

What is claimed is:

1. A lift and transfer apparatus for patient, comprising (1) a transferring mechanism including:

a support base two support rods pivoted to the support base at rear portions close to rear ends thereof; two front wheels connected to front ends of the support rods; a plurality of rear wheels; and a control member, the control member being pivoted to the support base at a middle portion of an actuating rod thereof; the control member having a pedal rod joined to the actuating rod for changing orientation of the actuating rod with; the control member having two connecting rods; the connecting rods being pivoted to respective ones of the rear ends of the support rods at first ends, and pivoted to respective ones of two ends of the actuating rod at other ends;

(2) a lifting mechanism including:

a main support post connected to the support base at a lower end;

a lifting rod pivoted to an upper end of the main support post for allowing a patient to be hung thereon; and a lifting hydraulic cylinder connected to the lifting rod at an output rod thereof for changing height of the lifting rod with;

the support base having a securing portion projecting up therefrom; the securing portion having a locating room defined by front and rear plates, and left and right inverted L shaped plates longer than the front and the rear plates; each inverted L shaped plate having an inverted L shaped guiding slot substantially formed therealong; each inverted L shaped plate having a connecting hole on a lower end;

the main support post having an upper, a lower, and an intermediate through holes extending from a left side to a right side of the lower end thereof; the main support post being releasably secured to the securing portion of the support base with a first bolt passing through the lower through hole and the connecting holes of the inverted L shaped plates, and with a second bolt passing through the intermediate through hole and lower ends of the guiding slots;

the inverted L shaped guiding slots allowing the main support post to be displaced rewards of the present lift and transfer apparatus until the second bolt, which passes through the intermediate through hole, abuts rear ends of upper portions thereof after the first bolt has been removed, and the second bolt loosened, and after the main support post is pivoted down close to the support rods for folding the present apparatus, thus allowing length of the present apparatus, in folded position, to be reduced.

* * * * *